US006848424B2

(12) United States Patent
Watanabe

(10) Patent No.: US 6,848,424 B2
(45) Date of Patent: Feb. 1, 2005

(54) ACCUMULATION TYPE FUEL INJECTION SYSTEM

(75) Inventor: Toshikazu Watanabe, Nagoya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/712,028

(22) Filed: Nov. 14, 2003

(65) Prior Publication Data

US 2004/0094127 A1 May 20, 2004

(30) Foreign Application Priority Data

Nov. 15, 2002 (JP) ..... 2002-332703

(51) Int. Cl.[7] ..... F02B 77/00
(52) U.S. Cl. ..... 123/456; 123/198 DB
(58) Field of Search ..... 123/456, 468, 123/469, 470, 198 D, 198 DB, 510; 137/493.6

(56) References Cited

U.S. PATENT DOCUMENTS 4,539,959 A * 9/1985 Williams ..... 123/456
5,577,479 A * 11/1996 Popp ..... 123/458
5,692,476 A * 12/1997 Egler et al. ..... 123/456
5,775,302 A 7/1998 Guido et al.
5,957,507 A 9/1999 Asada
6,357,415 B1 * 3/2002 Mori ..... 123/198 DB
2003/0217726 A1 * 11/2003 Kennedy et al. ..... 123/198 D

* cited by examiner

*Primary Examiner*—Thomas Moulis
(74) *Attorney, Agent, or Firm*—Nixon & Vanderhye P.C.

(57) ABSTRACT

A common rail of an accumulation type fuel injection system has a common rail main body, distributing portions and accessory portions. The common rail main body provides an accumulation chamber for accumulating high-pressure fuel discharged from a high-pressure supply pump. The distributing portion can be connected with a pressure introduction pipe for introducing the accumulated high-pressure fuel to an injector mounted to a cylinder. The accessory portion is disposed on a fuel outlet side of the distributing portion and is connected with the distributing portion and the high-pressure pipe in thread connection. The accessory portion has a sealing member between the accessory portion and a connection object on the distributing portion side. The sealing member has a sealing surface formed substantially in the shape of a spherical surface on the connection object side.

7 Claims, 4 Drawing Sheets

ACCUMULATION TYPE FUEL INJECTION SYSTEM

CROSS REFERENCE TO RELATED APPLICATION

This application is based on and incorporates herein by reference Japanese Patent Application No. 2002-332703 filed on Nov. 15, 2002.

BACKGROUND OF THE INVENTION

1. Field of the Invention

The present invention relates to an accumulation type fuel injection system, in particular to sealing structure of an accumulation device of the accumulation type fuel injection system.

2. Description of Related Art

As one of accumulation type fuel injection systems, a common rail type fuel injection system for a diesel engine having a high-pressure supply pump and a common rail is known, for instance. The high-pressure supply pump is rotated by a crankshaft of the diesel engine so that the supply pump pressurizes fuel drawn from a fuel tank and discharges the high-pressure fuel. The common rail functions as a kind of surge tank for accumulating the high-pressure fuel discharged from the high-pressure supply pump.

The fuel is accumulated in the common rail at a relatively high pressure (a pressure 100 to 1000 times as high as the atmospheric pressure, or more). The accumulated fuel is supplied to combustion chambers of cylinders by injection through injectors mounted on the cylinders. A certain common rail as the accumulation device of this kind has structure in which a flow limiter is attached to the common rail as shown in FIG. 4. The flow limiter stops the fuel supply to the injector if the high-pressure fuel is injected from the injector excessively. In the common rail structure, the common rail is formed in a deformed shape so that a thickened screw portion, which is screwed and connected with the flow limiter, and a common rail main body are formed in a single piece. Since the common rail is formed into the deformed shape in a single piece, processing accuracy in perpendicularity between a central axis of the screw portion and a flat surface of a flat sealing portion of the common rail main body can be achieved easily and high-pressure sealing structure can be maintained.

As shown in FIG. 4, the flow limiter has a body formed with a screw portion screwed with the common rail, a valve member capable of moving in an axial direction in the body, and a spring for biasing the valve member toward the flat sealing portion. The flat sealing portion contacts a lower end surface of the valve member to define an initial position of the valve member so that a moving distance of the valve member in the axial direction is set to a predetermined distance. The valve member moves in the axial direction in accordance with an upstream and downstream pressure difference.

However, the common rail having the structure of the conventional technology is the deformed product formed by forging and the like. Therefore, there is a problem that production cost is relatively high.

A joined common rail can be employed as a countermeasure to the above problem. The joined common rail is made by forming the common rail main body and the thickened screw portion as separate parts and by joining the thickened screw portion to the common rail main body into the single common rail by welding and the like. The thickened screw portion and the common rail main body formed as the separate parts are joined with each other with heat by welding, in which both the thickened screw portion and the common rail main body are melted, or by blazing with blazing filler. Therefore, under some welding conditions or blazing conditions, there is a possibility that a central axis of a threaded portion of the thickened screw portion may not become perpendicular to the flat surface of the flat sealing portion, and the thickened screw portion may be joined in an inclined state. In this case, there is a possibility that the flat sealing portion may contact a sealing portion of the flow limiter unevenly. As a result, high-pressure sealing performance may be degraded.

SUMMARY OF THE INVENTION

It is therefore an object of the present invention to provide an accumulation type fuel injection system, which is formed in inexpensive structure and is capable of improving high-pressure sealing performance.

It is another object of the present invention to provide an accumulation type fuel injection system having an accumulation device, which has an accessory portion corresponding to a safety device and supplies accumulated high-pressure fuel though the accessory portion, so that the accumulation type fuel injection system is formed in inexpensive structure and is capable of improving high-pressure sealing performance.

According to an aspect of the present invention, an accumulation type fuel injection system has a high-pressure supply pump, which is driven by an internal combustion engine to rotate so that the high-pressure supply pump pressurizes and discharges drawn fuel, and an accumulation device for accumulating the high-pressure fuel discharged from the high-pressure supply pump. The accumulation type fuel injection system supplies the accumulated high-pressure fuel to cylinders of the internal combustion engine through injectors mounted to the cylinders. The accumulation device has a common rail main body, distributing portions and accessory portions. The common rail main body is formed with an accumulation chamber for accumulating the high-pressure fuel. The distributing portion can be connected with a pressure introduction pipe for introducing the high-pressure fuel accumulated in the common rail main body to each injector. The accessory portion is disposed on a fuel outlet side of the distributing portion and is connected to the distributing portion and the pressure introduction pipe in thread connection. Each accessory portion has a sealing member between the accessory portion and a connection object on the distributing portion side, to which the accessory portion is connected in thread connection. A sealing surface of the sealing member on the connection object side is formed in the shape of a substantially spherical surface.

Thus, the accumulation device (the common rail) as a kind of surge tank of the above accumulation type fuel injection system for accumulating high-pressure fuel supplied to the respective cylinders of the internal combustion engine has the common rail main body, the distributing portions and the accessory portions. The distributing portion can be connected with the pressure introduction pipe corresponding to each cylinder. The accessory portion is disposed on an outlet side of the distributing portion and is connected with the distributing portion and the pressure introduction pipe in thread connection. In this case, generally, each accessory portion has to be screwed to a threaded portion formed on an inner peripheral surface of the distributing portion, and an end surface of the accessory portion and an innermost surface on an inner peripheral side of the distributing portion have to be sealed. For instance, sealing performance can be maintained suitably by improving processing accuracy in perpendicularity of a sealing surface with respect to a central axis of the threaded portion. However, production cost of process such as a threading process of the threaded portion through a forging process or a cutting process is increased. Specifically, compared to the processing of an external surface, the processing accuracy in the perpendicularity between a female thread and the innermost surface is difficult to achieve in the case where the female thread, or an internal surface, is processed.

On the contrary, the sealing member having a sealing surface in the shape of a substantially spherical surface on the connection object side is disposed between the accessory portion and the connection object on the distributing portion side. The accessory portion is connected to the distributing portion in thread connection. Therefore, even if the inclination of a central axis of the threaded portion remains deviated, or even if the accessory portion remains inclined, the sealing member can be connected to the connection object through the spherical surface of the sealing member, while the sealing member is positioned arbitrarily.

Accordingly, even in the case where the inclination of the central axis of the threaded portion is deviated, a fastening force generated by the thread connection can be applied to the connection object stably through the sealing member having the spherical surface. Therefore, variation in processing accuracy is permitted, so inexpensive structure is achieved. Sealing performance can be improved by employing the connection structure for connecting the accessory portion to the connection object in thread connection through the sealing member having the spherical surface.

BRIEF DESCRIPTION OF THE DRAWINGS

Features and advantages of an embodiment will be appreciated, as well as methods of operation and the function of the related parts, from a study of the following detailed description, the appended claims, and the drawings, all of which form a part of this application. In the drawings:

DETAILED DESCRIPTION OF THE REFERRED EMBODIMENT

Figure 1:
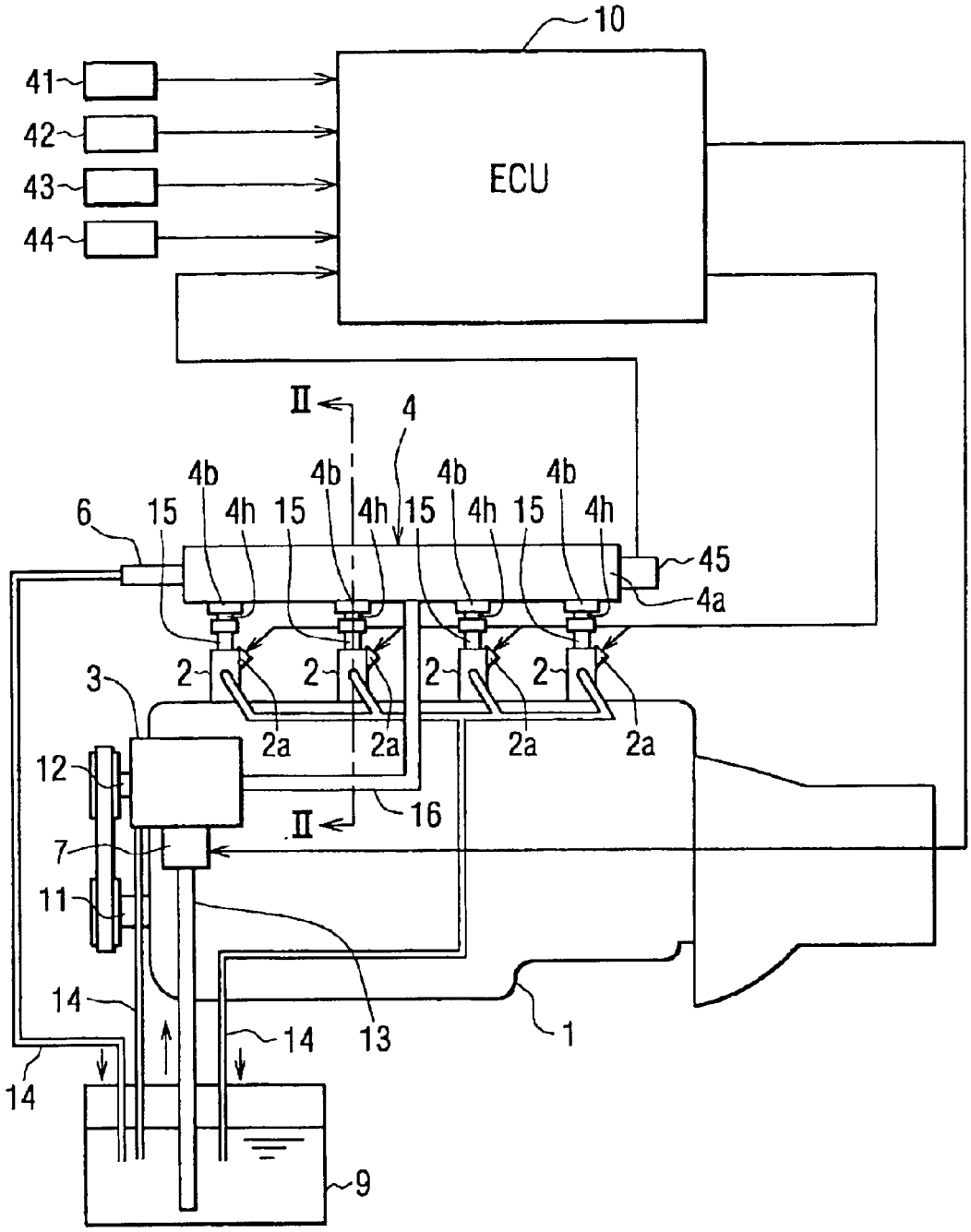
FIG. 1 is a schematic structural diagram showing a common rail type fuel injection system according to the present embodiment of the present invention.

Referring to FIG. 1, a common rail type fuel injection system as an accumulation type fuel injection system of the present embodiment of the present invention is illustrated. The common rail type fuel injection system in FIG. 1 is mounted to a diesel engine.

As shown in FIG. 1, the common rail type fuel injection system has a plurality of (four, in the present embodiment) injectors 2, a high-pressure supply pump 3, a common rail 4, and an electronic control unit (an ECU) 10. The injectors 2 are mounted to respective cylinders of a multi-cylinder internal combustion engine (a multi-cylinder engine) 1 such as a multi-cylinder diesel engine. The high-pressure supply pump 3 is driven by the multi-cylinder engine 1 to rotate. The common rail 4 functions as the accumulation device for accumulating the high-pressure fuel discharged from the high-pressure supply pump 3. The ECU 10 electronically controls the plurality of injectors 2. The ECU 10 is a control device for controlling the engine 1. The ECU 10 is controlling means for controlling the high-pressure supply pump 3 and the like, in addition to the injectors 2.

The injector 2 is a fuel injection valve mounted to a combustion chamber of each cylinder of the multi-cylinder engine 1 for supplying the high-pressure fuel into the combustion chamber by injection. The ECU 10 electronically controls start and stop of energization to an injection period controlling electromagnetic valve (injection period varying means) 2*a* as an actuator. Thus, the ECU 10 determines characteristics of the fuel injection into the combustion chamber of the multi-cylinder engine 1 from the injector 2 such as fuel injection quantity or fuel injection timing. The injector 2 mounted to each cylinder of the multi-cylinder engine 1 supplies the high-pressure fuel accumulated in the common rail 4 into the combustion chamber of the cylinder while the injection period controlling electromagnetic valve 2*a* is open.

The high-pressure supply pump 3 has a known low-pressure feed pump, a plunger and a pressurizing chamber (a plunger chamber). A pump driving shaft 12 rotates in accordance with the rotation of a crankshaft 11 of the multi-cylinder engine 1, so the low-pressure feed pump draws the fuel from a fuel tank 9. The plunger is driven by the pump driving shaft 12. The pressurizing chamber pressurizes the fuel by reciprocating motion of the plunger. The high-pressure supply pump 3 is a supply pump for pressurizing the fuel drawn by the low-pressure feed pump through a fuel pipe 13 and for discharging the fuel to the common rail 4. An inlet flow control valve (an injection pressure controlling electromagnetic valve) 7 is disposed on an inlet side of a fuel passage leading to the pressurizing chamber of the high-pressure pump 3. The inlet flow control valve 7 functions as an actuator for opening or closing the fuel passage. The inlet flow control valve 7 is a flow control valve as a discharge quantity controlling electromagnetic valve for controlling the discharging quantity of the fuel discharged from the high-pressure supply pump 3 to the common rail 4. The inlet flow control valve 7 is electronically controlled by a control signal from the ECU 10. The inlet flow control valve 7 is controlled by the ECU 10 to regulate pressure-feeding quantity, or discharging quantity, of the high-pressure fuel pressure-fed from the high-pressure supply pump 3 to the common rail 4 through a fuel pipe 16. Thus, the inlet flow control valve 7 functions as injection pressure varying means for varying the injection pressure for injecting the fuel from the respective injectors 2 into the combustion chambers of the multi-cylinder engine 1.

The common rail 4 is a kind of surge tank for accumulating the fuel at a relatively high pressure (a common rail pressure 100 to 1000 times as high as the atmospheric pressure, or more) and is the accumulation device for accumulating the high-pressure fuel at the common rail pressure. The common rail 4 is required to continuously and fluid-tightly accumulate the high common rail pressure corresponding to fuel injection pressure. Therefore, the common rail 4, the fuel passage for introducing the high-pressure fuel from the high-pressure supply pump 3 to the common rail 4 and the fuel passages for introducing the high-pressure fuel from the common rail 4 to the injectors 2 are required to have mechanical strength and high pressure tightness enough to withstand the common rail pressure.

Therefore, the fuel pipe 16 for introducing the high-pressure fuel from the high-pressure supply pump 3 to the common rail 4 is provided as a high-pressure fuel passage formed of a pressure introduction pipe (a high-pressure pipe) such as an injection steel pipe capable of fluid-tightly connecting the high-pressure supply pump 3 with the common rail 4. The fuel passages for introducing the high-pressure fuel from the common rail 4 to the injectors 2 are provided by high-pressure pipes 15 formed of high-pressure fuel passages capable of fluid-tightly connecting the common rail 4 with the injectors 2.

A pressure limiter 6 is mounted to the common rail 4 for preventing the common rail pressure in the common rail 4 from exceeding a limit accumulation pressure. The pressure can be released through the pressure limiter 6. Return fuel from the pressure limiter 6, leak fuel from the injectors 2 and overflow fuel from the high-pressure supply pump 3 is returned to the fuel tank 9 through leak pipes (low-pressure pipes) 14 as low-pressure fuel passages.

The ECU 10 is a known microcomputer including a CPU for performing control processing and calculation processing, ROM for storing various programs and data, RAM for storing input data, an input circuit, an output circuit, a power source circuit, an injector driving circuit and a high-pressure pump driving circuit. Sensor signals outputted from various sensors are inputted to the microcomputer after the sensor signals are converted from analog signals to digital signals by an A/D converter. The ECU 10 includes injection quantity and fuel injection timing determining means, injection pulse width determining means and injector driving means. The injection quantity and fuel injection timing determining means determines optimum injection timing (injection start timing) and the fuel injection quantity (an injection period corresponding to the fuel injection quantity) in accordance with an operating condition of the multi-cylinder engine 1. The injection pulse width determining means calculates an injector injection pulse having an injection pulse period (injection pulse width) corresponding to the operating condition of the multi-cylinder engine 1 and the fuel injection quantity. The injector driving means applies the injection period controlling electromagnetic valve 2*a* of the injector 2 of each cylinder with the injector injection pulse through the injector driving circuit (EDU). The ECU 10 also functions as discharge quantity controlling means for calculating the optimum fuel injection pressure, or the optimum common rail pressure, in accordance with the operating condition of the multi-cylinder engine and for performing driving control of the injection pressure controlling electromagnetic valve 7 of the high-pressure supply pump 3 through the high-pressure pump driving circuit (EDU). The ECU 10 calculates the fuel injection quantity, the injection timing and the target common rail pressure by using operating condition detecting means for detecting the signals representing the operating condition of the multi-cylinder engine 1 such as a rotation speed sensor 41 for sensing rotation speed of the multi-cylinder engine 1, an accelerator position sensor 42 for sensing a depressed degree of an accelerator pedal (an accelerator position), and a cooling water temperature sensor 43 for sensing cooling water temperature. The fuel injection quantity, the injection timing and the target common rail pressure may be corrected by considering detection signals (engine operation information) from other sensors 44 as the operating condition detecting means such as an intake temperature sensor, a fuel temperature sensor, an intake pressure sensor, a cylinder determination sensor and an injection timing sensor.

Next, the common rail 4 as the accumulation device as a substantial part of the accumulation type fuel injection system of the present invention will be explained based on FIGS. 1, 2 and 3. As shown in FIG. 1, the common rail 4 has a common rail main body 4*a*, inside which an accumulation chamber 4*c* for accumulating the high-pressure fuel is formed, and distributing portions 4*b*, which can be connected with the high-pressure pipes 15 for introducing the high-pressure fuel accumulated in the common rail main body 4*a* to the injectors 2 of the respective cylinders.

The common rail main body 4*a* is formed into a predetermined shape through a forging process, a cutting process for cutting its entire surface, a drawing process or a flatting process. As the predetermined shape of the common rail main body 4*a*, the common rail main body 4*a* is formed substantially in the shape of a relatively thick pipe. A cross-section of the accumulation chamber 4*c* formed inside the common rail main body 4*a* is formed substantially in the shape of a round or an ellipse. The accumulation chamber 4*c* extends in a longitudinal direction of the common rail main body 4*a* (in a lateral direction in FIG. 1). Thus, the common rail 4 has a simple shape, which can be easily formed through the drawing process or the flatting process. Therefore, production cost for processing is reduced.

Figure 4:
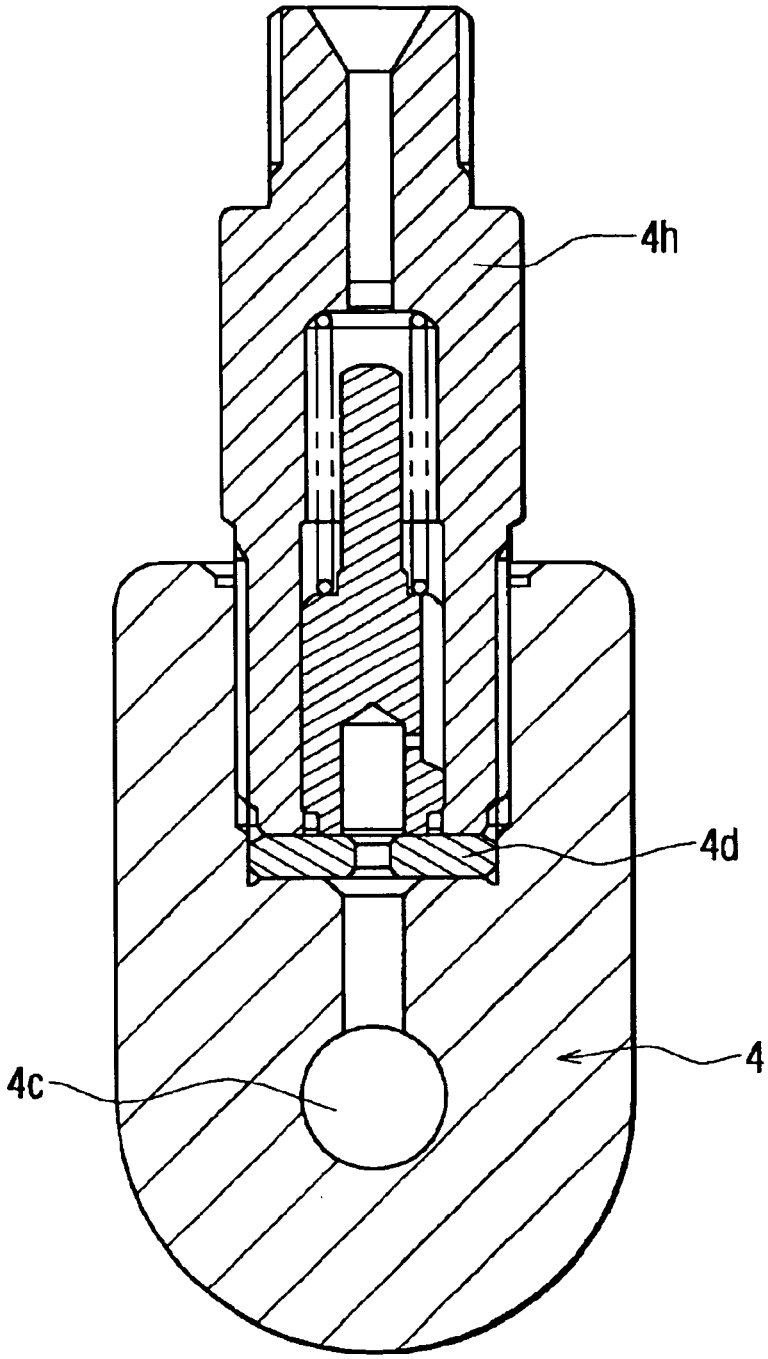
FIG. 4 PRIOR ART
FIG. 4 is a cross-sectional view showing a common rail of a conventional common rail type fuel injection system.

In the case where the common rail main body 4*a* is formed by forging, the common rail main body 4*a* is merely formed substantially into the shape of a pipe. Therefore, compared to the forged product formed into the deformed member having the conventional structure shown in FIG. 4, structure of a forging die can be simplified and the increase in the processing cost of the forging process can be inhibited.

Figure 2:
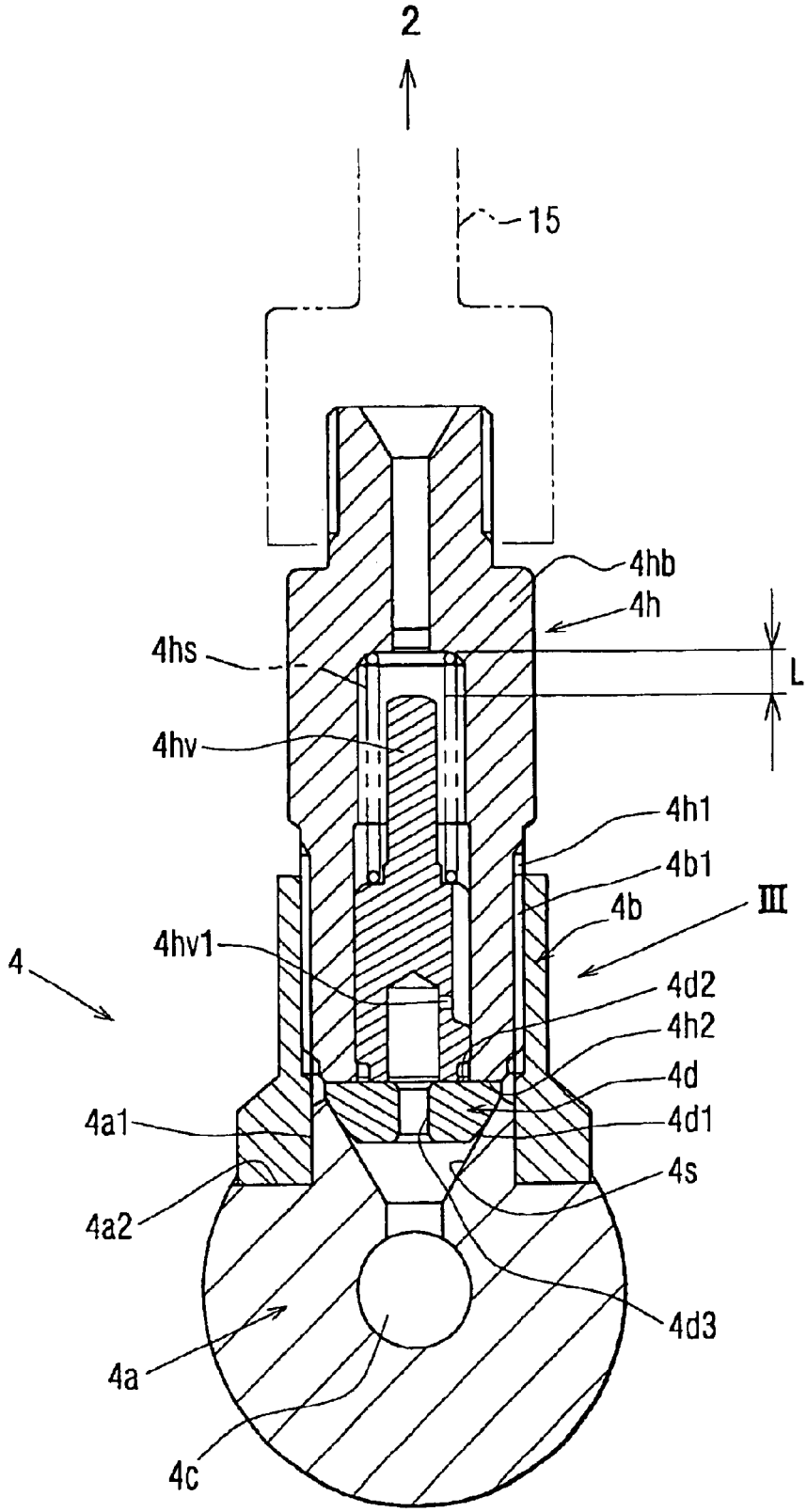
FIG. 2 is a cross-sectional diagram showing a common rail shown in FIG. 1 taken along the line II—II.

The distributing portion 4*b* is formed substantially in the shape of a cylinder as shown in FIG. 2. The distributing portions 4*b* and the common rail main body 4*a* are formed as separate parts in advance through separate processes, for instance. Then, the common rail main body 4*a* and the distributing portions 4*b* are integrated by welding or brazing. The distributing portions 4*b* connected with the common rail main body 4*a* branch substantially perpendicularly to the longitudinal direction of the common rail main body 4*a*, in which the accumulation chamber 4*c* extends, as shown in FIGS. 1 and 2. Thus, the high-pressure fuel is distributed toward the injectors 2 disposed in the respective cylinders of the multi-cylinder engine 1.

Thus, the common rail main body 4*a* and the distributing portions 4*b* are formed as the separate parts and are integrated by the welding and the like. Therefore, unlike the conventional forged product, there is no need to form the common rail 4 in a single piece by shaping a complicated and deformed member. Thus, the production cost can be reduced. The common rail main body 4*a*, to which the distributing portions 4*b* are connected, should preferably have cylindrical portions 4*a*1 formed substantially concentrically with connection objects (innermost surfaces, sealing surfaces) 4*s* on the sides of the distributing portions 4*b* respectively, and stepped surfaces 4*a*2 formed around the cylindrical portions 4*a*1 respectively. Thus, an inner periphery of each distributing portion 4*b* can be connected to the cylindrical portion 4*a*1. Meanwhile, a connecting area for connecting a lower end surface of the distributing portion 4*b* with the stepped surface 4*a*2 by welding can be ensured easily.

Moreover, in the present embodiment, as shown in FIGS. 1 and 2, an accessory portion (a flow limiter) 4*h* corresponding to a safety device is disposed on an outlet side of each distributing portion 4*b*. The accessory portion 4*h* is connected with the distributing portion 4*b* and the high-pressure pipe 15 in thread connection respectively. Moreover, as shown in FIG. 1, the accessory portion 4*h* and the distributing portion 4*b* seal a lower end surface 4*h*2 of the accessory portion 4*h* and the innermost surface 4*s* formed radially inside the inner periphery of the distributing portion 4*b*, at which a threaded portion 4*b*1 for the thread connection is formed, through a sealing member 4*d* with a fastening axial force generated by the thread connection.

The accessory portion 4*h* is screwed with the threaded portion 4*b*1 formed on an inner peripheral surface of the distributing portion 4*b*. An end portion (a lower end surface) 4*h*2 of the accessory portion 4*h* and the innermost surface 4*s* radially inside the distributing portion 4*b* are required to be sealed so that high-pressure sealing performance is maintained. In this case, generally, accuracy of form related to physical relationship between the threaded portion 4*b*1 of the distributing portion 4*b*, which partially or entirely accommodates the accessory portion 4*h*, and the innermost surface 4*s* has to be improved. For instance, processing accuracy of the perpendicularity between the flat surface of the flat sealing surface as the connection object and the central axis of the threaded portion has to be improved like the conventional structure shown in FIG. 4. By improving the processing accuracy, the high-pressure sealing performance can be improved. However, the processing cost will be increased. For instance, in the case of the forged common rail, a die accuracy of a die used in the forging pressing has to be improved. As a result, the processing cost is increased.

Figure 3:
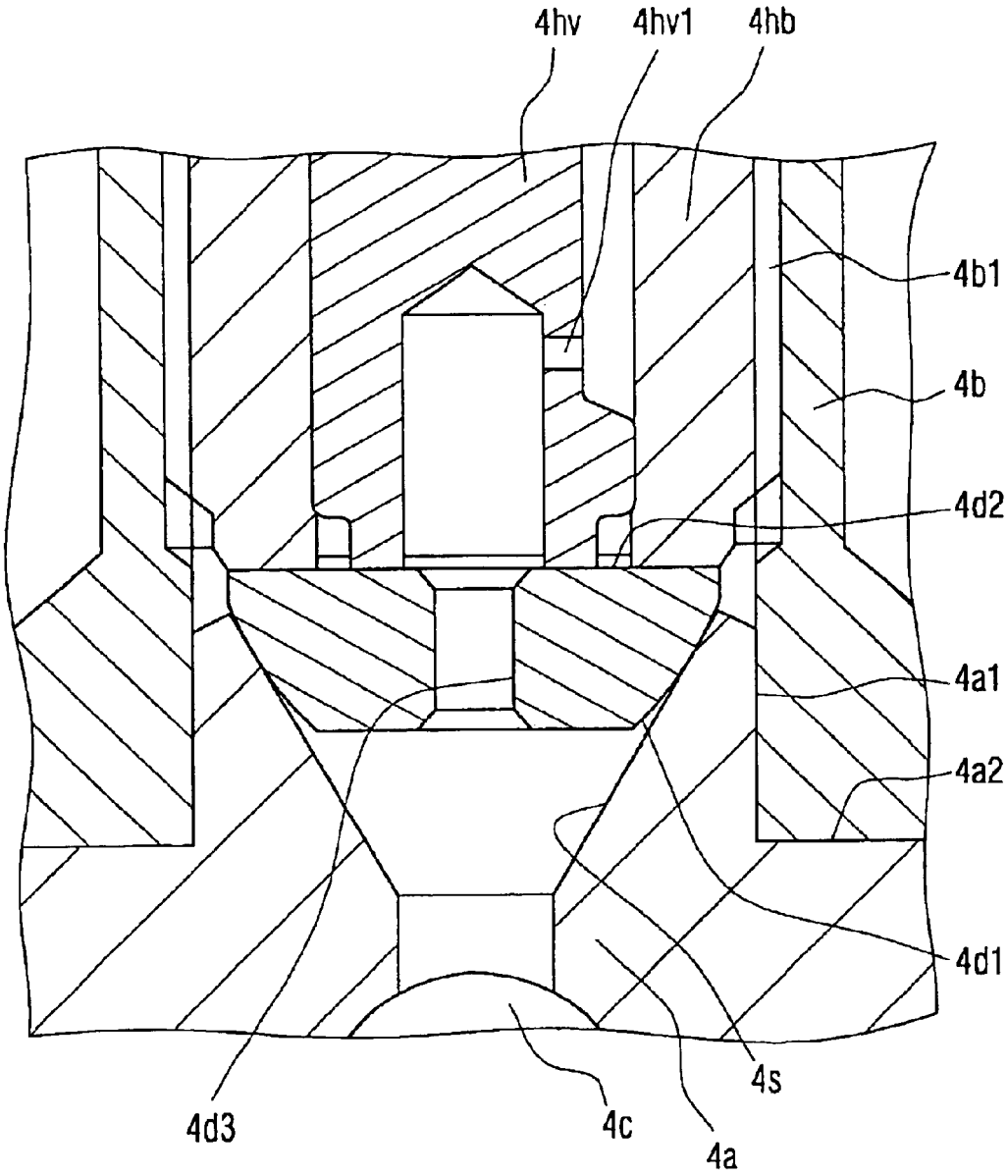
FIG. 3 is an enlarged fragmentary diagram showing an area III in FIG. 2.

On the contrary, in the present embodiment, as shown in FIGS. 2 and 3, the sealing member 4*d* having a fuel passage 4*d*3 is disposed between the accessory portion 4*h* and the sealing surface 4*s* as the connection object on the distributing portion 4*b* side, to which the accessory portion 4*h* is connected in the thread connection. A sealing surface 4*d*1 of the sealing member 4*d* on the connection object 4*s* side is formed substantially in the shape of a spherical surface. The sealing surface 4*s* as the connection object is formed in the shape of a conical surface as shown in FIGS. 2 and 3. Therefore, the sealing member 4*d* can be connected to the connection object 4*s* even if the axis, or a position, of the sealing member 4*d* is set arbitrarily with respect to the connection object 4*s*. As a result, the accessory portion 4*h*, the sealing member 4*d* and the connection object 4*s* on the distributing portion 4*b* side can contact each other fluid-tightly in a state in which the inclinations of the central axes of the accessory portion 4*h* and the sealing member 4*d* are deviated from the central axis of the connection object 4*s*. More specifically, even in the case where the positional accuracy in the physical relationship between the threaded portion 4*b*1 and the connection object 4*s* is set within a predetermined tolerance, the fastening axial force generated by screwing the accessory portion 4*h* can be applied evenly to the spherical surface 4*d*1 of the sealing member 4*d*, the substantially conical surface of the connection object 4*s* and a sealing portion of the accessory portion 4*h* in a state in which the central axis of the threaded portion 4*b*1 is inclined within the tolerance, or in the state in which the accessory portion 4*h* fitted to the threaded portion 4*b*1 in the thread connection remains inclined.

Therefore, the high-pressure sealing performance can be improved without increasing the processing accuracy of the threaded portion 4*b*1 and the connection object 4*s* even in the case where the positional accuracy is set within the predetermined tolerance. As a result, the production cost can be reduced, and meanwhile, the common rail 4 as the accumulation device capable of improving the high-pressure sealing performance can be produced.

In the above embodiment, the threaded portion 4*b*1 formed on the distributing portion 4*b*, which is integrated with the common rail main body 4*a* by welding and the like, is the thread formed on the inner peripheral surface of the distributing portion 4*b*, or the female thread. Alternatively, the threaded portion 4*b*1 may be a male thread formed on an outer peripheral surface of the distributing portion 4*b*. The processing for achieving a predetermined positional accuracy in the central axis of the threaded portion 4*b*1 with respect to the connection object 4*s* is more difficult in the case where the female thread is formed than in the case where the male thread is formed by processing the outer peripheral surface. In the case where the sealing member 4*d* having the spherical surface 4*d*1 is employed, the effect of reducing the production cost is relatively great in the case where the threaded portion 4*b*1 is formed on the inner peripheral surface of the distributing portion 4*b*.

The present invention can be suitably applied to the structure in which the common rail main body 4*a* and the distributing portions 4*b* are formed as the separate parts in the preceding process, and the common rail main body 4*a* and the distributing portions 4*b* are integrated by the welding or the brazing. Thus, the fastening force generated by screwing the accessory portion 4*h* and the distributing portion 4*b* with each other can be applied stably to the connection object 4*s* through the sealing member 4*d* having the spherical surface 4*d*1, even in the case where the central axis of the threaded portion 4*b*1 of the distributing portion 4*b* is inclined with respect to the connection object 4*s*. The inclination of the central axis of the threaded portion 4*b*1 is caused under some melting conditions at the welded surfaces of the common rail main body 4*a* and the distributing portion 4*b* or under some brazing conditions of the brazing with the brazing filler. Thus, the inexpensive structure can be compatible with the improvement of the high-pressure sealing performance.

The accessory portion (the flow limiter) 4*h* has a body 4*hb*, a valve member 4*hv* and a spring 4*hs*. The body 4*hb* is formed with a screw 4*h*1, which is threaded to the distributing portion 4*b*. The valve member 4*hv* is capable of reciprocating in an axial direction in the body 4*hb*. The spring 4*hs* biases the valve member 4*hv* toward a root of the distributing portion 4*b* (toward the common rail main body 4*a*). The accessory portion 4*h* is a safety device for stopping the fuel supply from the common rail 4 to the injector 2 in the case where the injector 2 injects the high-pressure fuel excessively. Thus, in a normal state, the accessory portion 4*h* functions as a part of the fuel passage constituting the distributing portion 4*b* for introducing the high-pressure fuel to the injector 2. On the other hand, only in the case where the injector 2 injects the high-pressure fuel excessively, the accessory portion 4*h* functions as the safety device to limit the supply of the high-pressure fuel to the injector 2.

In the present embodiment, as shown in FIG. 2, a restrictor 4*hv*1 is formed in the valve member 4*hv* for connecting an upstream side and a downstream side of the valve member 4*hv*. When the high-pressure fuel flows toward the injector 2 from the accumulation chamber 4*c* of the common rail main body 4*a* through the accessory portion 4*h*, a pressure difference (an upstream and downstream pressure difference) is generated between the upstream side and the downstream side of the valve member 4*hv* by a restricting effect of the restrictor 4*hv*1. The upstream and downstream pressure difference increases as the flow rate of the high-pressure fuel increases. As shown in FIG. 2, the accessory portion 4*h* has known valve structure in which a maximum travel distance of the valve member 4*hv* is defined by a separation distance L between a stepped fuel passage formed on an inner surface of the body 4*hb* and the valve member 4*hv*, and the maximum travel distance L is set to a distance corresponding to a maximum limit fuel supply flow rate.

In the present embodiment, the valve member 4*hv* contacts the sealing member 4*d*, so an initial position of the valve member 4*hv* for determining the maximum travel distance L of the valve member 4*hv* is limited as shown in FIG. 2. A surface of the sealing member 4*d* substantially opposite from an end surface 4*d*2 of the sealing member 4*d*, at which the sealing member 4*d* contacts the valve member 4*hv*, is formed into the substantially spherical surface 4*d*1, which contacts the conical sealing surface 4*s* as the connection object. The end surface 4*d*2 is formed in the shape of a flat surface as shown in FIG. 2. Thus, even in the case where the central axis of the threaded portion 4*b*1 of the distributing portion 4*b* is inclined, the body 4*hb* and the sealing member 4*d* contact each other at entire peripheries thereof as shown in FIGS. 2 and 3, without partially contacting each other. It is because the sealing surface 4*d*1 of the sealing member 4*d* is formed substantially in the shape of the spherical surface, and the sealing member 4*d* contacts the substantially conical sealing surface 4*s* in a state where the substantially spherical sealing surface 4*d*1 is inclined along the conical sealing surface 4*s*. Therefore, the valve member 4*hv* can contact the end surface 4*d*2 of the sealing member 4*d* stably, and the initial position of the valve member 4*hv* for determining the maximum travel distance L of the valve member 4*hv* can remain stabled even in the case where the central axis of the threaded portion 4*b*1 is inclined.

In the present embodiment, the accessory portion 4*h* is explained as the flow limiter. However, the accessory portion 4*h* is not limited to the flow rate limiting device such as the flow limiter for limiting the supply quantity of the high-pressure fuel. Alternatively, any safety device such as a pressure limiting device including the pressure limiter 6, which limits the common rail pressure under the permissible pressure by returning the fuel, which provides the excessively high pressure, to the low-pressure fuel passage 14 in the case where the pressure of the high-pressure fuel becomes excessively high, may be employed as the accessory portion 4*h*. Alternatively, any other device can be employed as the accessory portion 4*h* if the device does not degrade the function of supplying the high-pressure fuel from the common rail 4 to the injector 2 in the normal state.

The present invention should not be limited to the disclosed embodiment, but may be implemented in many other ways without departing from the spirit of the invention.

What is claimed is:

1. An accumulation type fuel injection system having a high-pressure supply pump, which is driven by an internal combustion engine to rotate so that the high-pressure supply pump pressurizes and discharges drawn fuel, and an accumulation device for accumulating the high-pressure fuel discharged from the high-pressure supply pump, the accumulation type fuel injection system supplying the accumulated high-pressure fuel to cylinders of the internal combustion engine through injectors mounted to the cylinders, wherein;

the accumulation device has a common rail main body providing an accumulation chamber for accumulating the high-pressure fuel, distributing portions capable of being connected with pressure introduction pipes for introducing the high-pressure fuel accumulated in the common rail main body to the injectors respectively and accessory portions, which are disposed on fuel outlet sides of the distributing portions and are connected with the distributing portions and the pressure introduction pipes respectively in thread connection, and the accessory portion has a sealing member between the accessory portion and a connection object on the distributing portion side, to which the accessory portion is connected in thread connection, the sealing member having a sealing surface substantially in the shape of a spherical surface on the connection object side.

2. The accumulation type fuel injection system as in claim 1, wherein the distributing portions and the common rail main body are formed as separate parts and are integrated through a joining process.

3. The accumulation type fuel injection system as in claim 2, wherein the distributing portions and the common rail main body are integrated through a welding process or a brazing process.

4. The accumulation type fuel injection system as in claim 2, wherein;

the common rail main body is formed of an injection steel pipe made through a drawing process or a flatting process, and the distributing portion is formed of a forged product or a cut product substantially in the shape of a cylinder, wherein the distributing portion has a threaded portion on an inner peripheral surface thereof near an end thereof.

5. The accumulation type fuel injection system as in claim 1, wherein the accessory portion is a safety device for stopping the fuel supply from the accumulation device to the injector in the case where the injector injects the high-pressure fuel excessively.

6. The accumulation type fuel injection system as in claim 5, wherein;

the accessory portion has a body, which is formed with a screw threaded to the distributing portion, a valve member, which is capable of moving in an axial direction inside the body, and a biasing spring for biasing the valve member toward the distributing portion, and the valve member contacts a surface of the sealing member substantially opposite from the sealing surface on the connecting object side so that an initial position of a travel distance of axial movement of the valve member is defined.

7. The accumulation type fuel injection system as in claim 1, wherein the connection object is formed substantially in the shape of a conical surface.

* * * * *